US007114866B2

(12) United States Patent
Ueno et al.

(10) Patent No.: US 7,114,866 B2
(45) Date of Patent: Oct. 3, 2006

(54) TAPE PRINTING APPARATUS

(75) Inventors: Hideo Ueno, Nagoya (JP); Hajime Okochi, Inazawa (JP); Hidekazu Ishii, Nakashima-gun (JP); Mizue Terai, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 232 days.

(21) Appl. No.: 10/926,984

(22) Filed: Aug. 27, 2004

(65) Prior Publication Data

US 2005/0147453 A1 Jul. 7, 2005

(30) Foreign Application Priority Data

Sep. 8, 2003 (JP) ..... 2003-315030

(51) Int. Cl.
*B41J 11/26* (2006.01)

(52) U.S. Cl. ..... 400/621; 400/613

(58) Field of Classification Search ..... 400/613–621
See application file for complete search history.

(56) References Cited

U.S. PATENT DOCUMENTS 4,568,951 A * 2/1986 Hasegawa et al. ..... 347/171
5,443,318 A * 8/1995 Kitazawa ..... 400/120.1
6,045,277 A 4/2000 Kurashina et al.
6,371,670 B1 4/2002 Kojo

FOREIGN PATENT DOCUMENTS

JP A-60-149478 8/1985
JP B2 2556232 9/1996

* cited by examiner

*Primary Examiner*—Minh Chau
(74) *Attorney, Agent, or Firm*—Oliff & Berridge, PLC

(57) ABSTRACT

A tape printing apparatus that prints a character string including a plurality of character regions divided by specified delimiting codes, which composes of space codes, tab codes and new block codes, onto a tape, there is provided a normal printing means for performing normal printing with the character region being in a normal order, and an inversed printing means for performing inversed order printing for printing a character string with the character regions being in inversed order.

43 Claims, 16 Drawing Sheets

FIG. 8A

| TAPE | FULL CUT | HALF CUT | NO CUT |
|---|---|---|---|

FIG. 8B

| NEW BLOCK | FULL CUT | HALF CUT | NO CUT |
|---|---|---|---|

FIG. 8C

| TAB | FULL CUT | HALF CUT | NO CUT |
|---|---|---|---|

FIG. 8D

| SPACE | FULL CUT | HALF CUT | NO CUT |
|---|---|---|---|

FIG. 9

| DELIMITING CODE | NEW BLOCK | SPACE | TAB |
|---|---|---|---|

FIG. 10

NORMAL PRINTING YES NO

TAPE PRINTING APPARATUS

CROSS-REFERENCE TO RELATED APPLICATION

This application claims priority from JP 2003-315030, filed Sep. 8, 2003, the entirety of which is incorporated herein by reference.

BACKGROUND OF THE INVENTION

1. Field of Invention

The present invention relates to a tape printing apparatus that prints characters or symbols onto a tape upon mounting a tape cassette therein.

2. Description of Related Art

Japanese Patent Publication No. 2,556,232 (Pages 3 to 6, FIG. 4) discloses a tape printing apparatus that includes a display portion and an input portion, for inputting characters, symbols or pictographic characters. The tape printing apparatus is provided with a cassette accommodating portion. The cassette accommodates therein a tape that is to be printed and an ink ribbon. A thermal head that fuses the ink ribbon to adhere to the tape is provided at a position opposing the tape and the ink ribbon of the cassette. In this manner, characters, etc. that have been input through the input portion can be printed onto the tape.

FIG. 16 illustrates one example of use of the tape printing apparatus of the above arrangement. In the example, a tape 102 that has been printed using the tape printing apparatus is adhered onto a surface of a plurality of circuit breakers 101 aligned on a distribution board 100. The tape 102 is formed with character regions 102*a* to 102*d* printed with characters indicating connectors corresponding to the respective breakers 101 to which they are connected. The plurality of character regions 102*a* to 102*d* are printed successively at specified intervals. In this manner, it is possible to simply indicate connectors to which the respective breakers 101 are to be connected.

Blank spaces between adjoining character regions 102*a* to 102*d* can be formed by space regions or tab regions by operating a space key or a tab key that are provided at the input portion. The input portion is also provided with a new block key. The new block key forms blocks of specified intervals. It is thus possible to perform printing upon aligning a plurality of character regions at specified intervals through blocks comprised of fixed regions of specified length.

SUMMARY OF THE INVENTION

In the above example of use, connection of electrical cables to the distribution board 100 is performed from a rear surface side of the circuit breakers 101. At this time, when connecting the cables corresponding to the proper breakers according to the tape 102 adhered on the surface of the breakers 101, work is slowed due to the positioning of the labels relative to the position of the installer and the cable insertion points on the breakers 101. A tape printed with members to be connected to in an order of alignment of the breakers 101 when seen from the rear surface side (thus, opposite when seen from the front surface side) is thus created and adhered to the rear surface side for performing connecting operations. When using the above conventional tape printing apparatus, it was accordingly necessary to create tapes upon inputting the same data twice in which the orders were changed, which lead to the drawback of worsened convenience to users.

It is one object of the present invention to provide a tape printing apparatus capable of improving convenience.

According to one aspect of the present invention, a tape printing apparatus is provided that prints a character string, including a plurality of character regions divided by specified delimiting codes. Such a tape printing apparatus comprises, a normal printing means for performing normal printing in which the character regions are printed in a normal order and an inversed order printing means for performing inversed order printing in which a character string is printed with the order of the character regions being inversed. Also included are a printing selecting means for selecting between the normal printing and the inversed order printing. According to this structure, a plurality of character regions, including desired characters, is input upon dividing the characters through delimiting codes. The tape printing apparatus is capable of performing printing of the respective character regions upon aligning them in an inversed order by the inversed order printing means.

It is accordingly possible to easily create a tape for indicating, for instance, connectors to be connected to on a distribution board when seen from the rear surface side, and thus to improve the convenience of the user who operates the tape printing apparatus.

The tape printing apparatus of the above structure further includes a successive printing means for successively performing the normal printing and the inversed order printing. According to this structure, when printing is instructed, a tape in which character regions are aligned in an inversed order and a tape in which they are aligned in a normal order are printed successively.

Because it is possible to perform normal printing and inversed order printing in a successive manner, tapes for a front surface side and for a rear surface side of a distribution board can be simultaneously obtained through a simple operation enabling the improvement of the operability of the tape printing apparatus.

In the tape printing apparatus of the above structure, the delimiting codes are comprised of either one of, or a plurality of space codes, tab codes and/or new block codes. According to this structure, space codes, tab codes and/or new block codes are input by operating a space key, a tab key or a new block key for delimiting between respective characters to thereby create adjoining character regions. It is accordingly possible to easily delimit character regions.

The tape printing apparatus of the above structure further comprises a delimiting code selecting means for selecting one or a plurality of space codes, tab codes or new block codes. With this structure, it is possible to delimit between character regions in accordance with the selections of the user to thereby improve the usability.

The tape printing apparatus of the above structure further comprises an inversing means for inversing placement of characters within the respective character regions when performing inversed order printing. With this structure, the character regions are formed of blocks with specified lengths being defined. When the characters are placed within the block in a right-aligned manner, they will be inversed as being aligned in a left-aligned manner when performing inversed order printing, while they are inversed to be aligned in a right-aligned manner when they were aligned in a left-aligned manner when performing inversed order printing.

Accordingly, intervals between characters within one character region and characters within an adjoining region can be made the same as when performing normal printing of normal order also when right-aligned or left-aligned character placement have been designated within a character region.

The tape printing apparatus of the above structure further comprises a replacing means for replacing space regions or tab regions that delimit between the character regions with characters within character regions when performing inversed order printing. With this structure, an adjoining character region is delimited by a space region or a tab region, and a space region or a tab region that is disposed at the end of the character region after aligning the character region in inversed order is replaced with characters within the character region. It is accordingly possible to dispose an adjoining character region after placement in inversed order at the same intervals as when performing normal printing.

The tape printing apparatus of the above structure further comprises a cutter mechanism that cuts the tape and a cutting condition setting means for setting the same cutting conditions by the cutter when performing normal printing and inversed order printing. With this structure, when it has been set to perform cutting at delimiting codes when performing normal printing, cutting is performed at the same delimiting codes also when performing inversed order printing. When it has been designated to perform half cutting when performing normal printing, half cutting is performed also when performing inversed order printing. It is accordingly not necessary to set a new cutting condition when performing inversed order printing thereby improving the operability.

BRIEF DESCRIPTION OF THE DRAWINGS

Hereinafter, the preferred exemplary embodiments of the present invention will be described in detail with reference to the accompanying drawings.

FIG. 8 is a view illustrating a setting screen for cutter setting of the tape printing apparatus according to an exemplary embodiment of the invention;

FIG. 9 is a view illustrating a setting screen for delimiting codes when performing inversed order printing in the tape printing apparatus according to an exemplary embodiment of the invention;

FIG. 10 is a view illustrating a setting screen for inquiring whether it is necessary to perform normal printing when performing inversed order printing in the tape printing apparatus according to an exemplary embodiment of the invention;

DETAILED DESCRIPTION OF PREFERRED EMBODIMENTS

Figure 1:
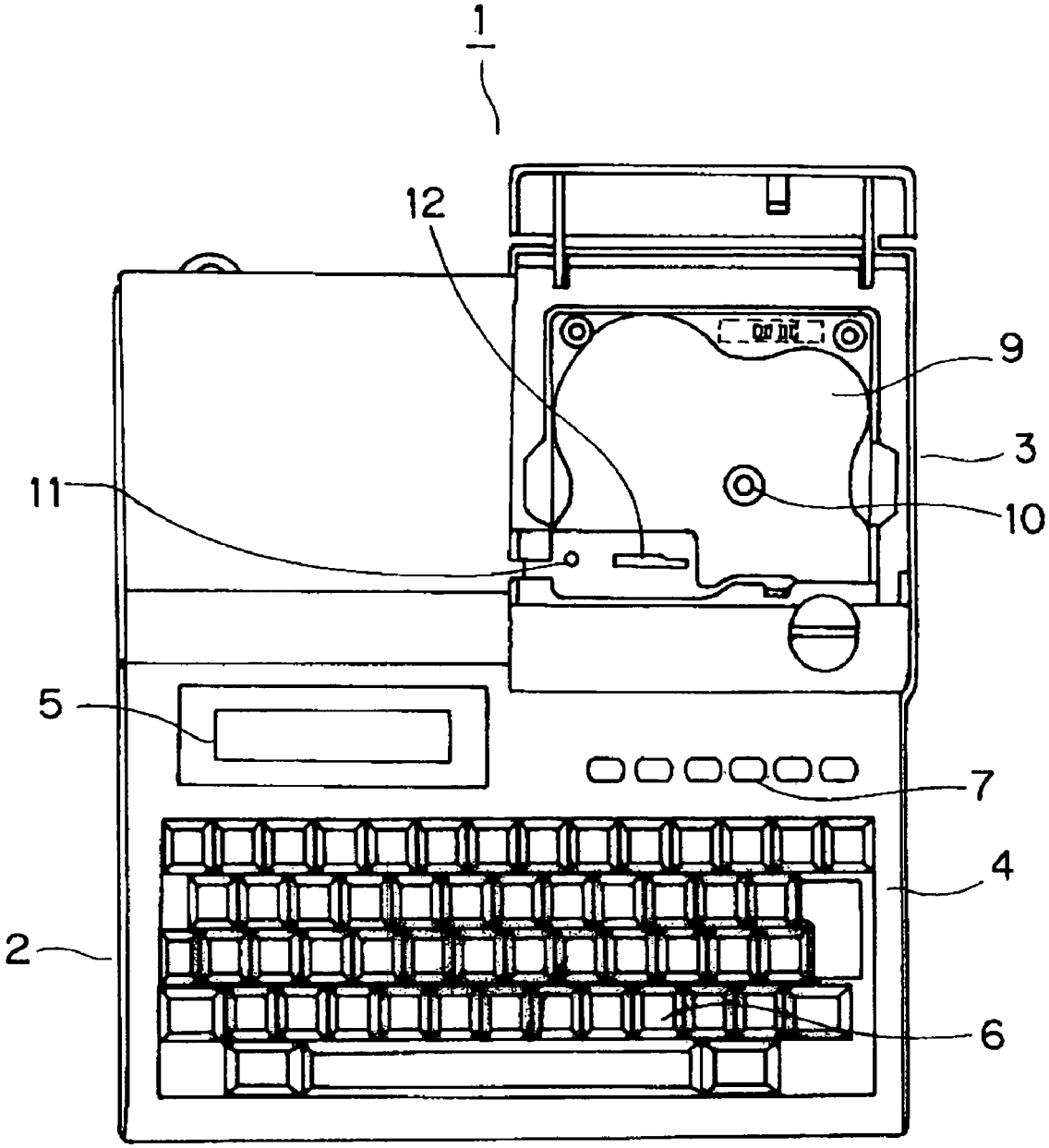
FIG. 1 is a plan view illustrating the tape printing apparatus according to an exemplary embodiment of the invention.

An exemplary embodiment of the present invention will now be explained with reference to the drawings. FIG. 1 is a plan view illustrating the tape printing apparatus according to one embodiment. An input portion 2 is disposed at a front portion of a tape printing apparatus 1 while a printing portion 3 is disposed at a rear portion thereof. The input portion 2 is comprised of a keyboard 4 and a display 5. The display 5 may be a liquid crystal display, or other appropriate means of display. The keyboard 4 is provided with character keys 6 through which characters, such as letters, numerals, and various symbols are input. The keyboard is also provided with various function keys 7. The function keys 7 include, for example, cursor moving keys, a print execution key, a CR key for inputting linefeed codes, and a new block key for inputting new block codes.

Figure 2:
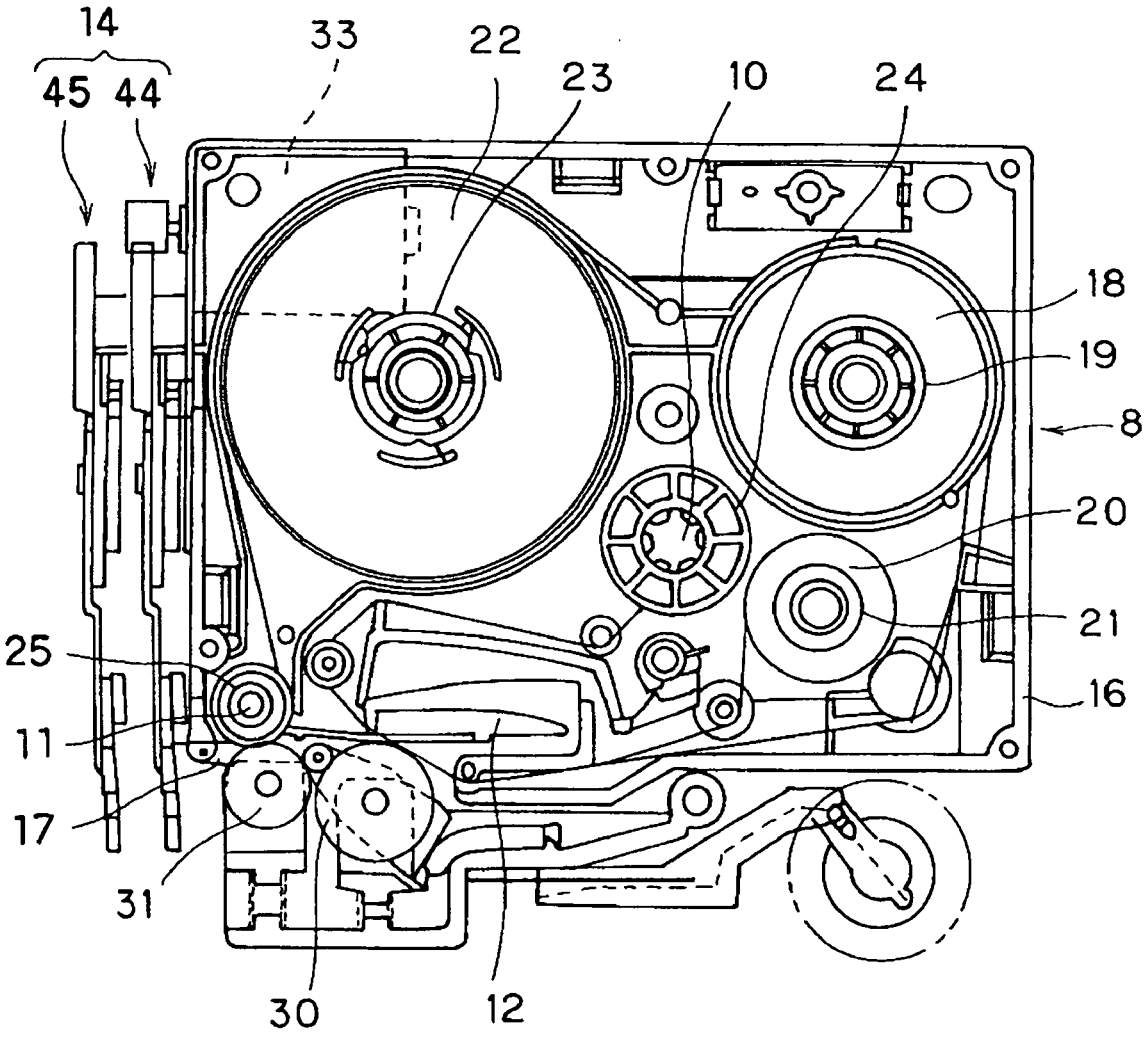
FIG. 2 is a plan view illustrating a cassette accommodating portion of the tape printing apparatus according to an exemplary embodiment of the invention.

The printing portion 3 is provided with a cassette accommodating portion 9 for accommodating a cassette 8 having a transparent tape 18 therein, an ink ribbon 20 and an adhesive tape 22 (see FIG. 2). The cassette accommodating portion 9 is provided with a ribbon take-up shaft 10 and a tape feeding shaft 11. The ribbon take-up shaft 10 and the tape feeding shaft 11 are rotated in conjunction with each other by a pulse motor 15 (see FIG. 3) and respectively perform taking up of the ink ribbon 20 and feeding of the transparent tape 18.

A thermal head 12 is disposed opposite the transparent tape 18 and the ink ribbon 20 of the accommodated cassette 8. The thermal head 12 includes a plurality of heater elements (not shown) aligned in a width direction of the tape and fuses the ink ribbon 20 to be adhered to the transparent tape 18. Printing is thus performed on the transparent tape 18.

FIG. 2 is a plan view illustrating an internal structure of the tape printing apparatus 1 of a portion of the cassette accommodating portion 9 with the cassette 8 being accommodated therein. The cassette 8 includes a plurality of spools 19, 21 and 23 within a case 16, wherein the transparent tape 18, the ink ribbon 20 and the adhesive tape 22 are respectively wound around the respective spools 19, 21 and 23. Both surfaces of the adhesive tape 22 are formed as adhesive surfaces, wherein a separator is adhered to one surface while the other surface is made to adhere to a printing surface of the transparent tape 18.

The ink ribbon 20 is taken up by a ribbon take-up spool 24 that is connected to the ribbon take-up shaft 10. A pressing roller 25 is provided proximate to an aperture 17 provided at one end of the case 16 so as to rotate in linkage with the tape feeding shaft 11.

A platen roller 30 and a tape feeding roller 31 are disposed at positions at which they oppose the thermal head 12 and the pressing roller 25. The platen roller 30 is pressed against the thermal head 12 with the ink ribbon 20 and the transparent tape 18 therebetween. With this structure, the ink of the ink ribbon 20 that is fused by the thermal head 12 can be adhered to the transparent tape 18.

The tape feeding roller 31 is pressed against the pressing roller 25 with the adhesive tape 22 and the transparent tape 18 between. The adhesive tape 22 and the transparent tape 18 adhering thereto can be sent out from the aperture 17 through rotation of the tape feeding shaft 11.

A cutter mechanism 14 is disposed at a side of the cassette accommodating portion 9. The cutter mechanism 14 includes a full cutter 44 for cutting the adhesive tape 22 and the transparent tape 18 and a half cutter 45 for cutting while leaving the separator of the adhesive tape 22. The full cutter 44 includes a rotatable movable blade (not shown) that approaches and separates with respect to a stationary blade (not shown). The movable blade is rotated by a DC motor 33. A full cut of the adhesive tape 22, and the transparent tape 18 that are sent from the aperture 17, is performed by a scissors action between the movable blade and the stationary blade.

Figure 15:
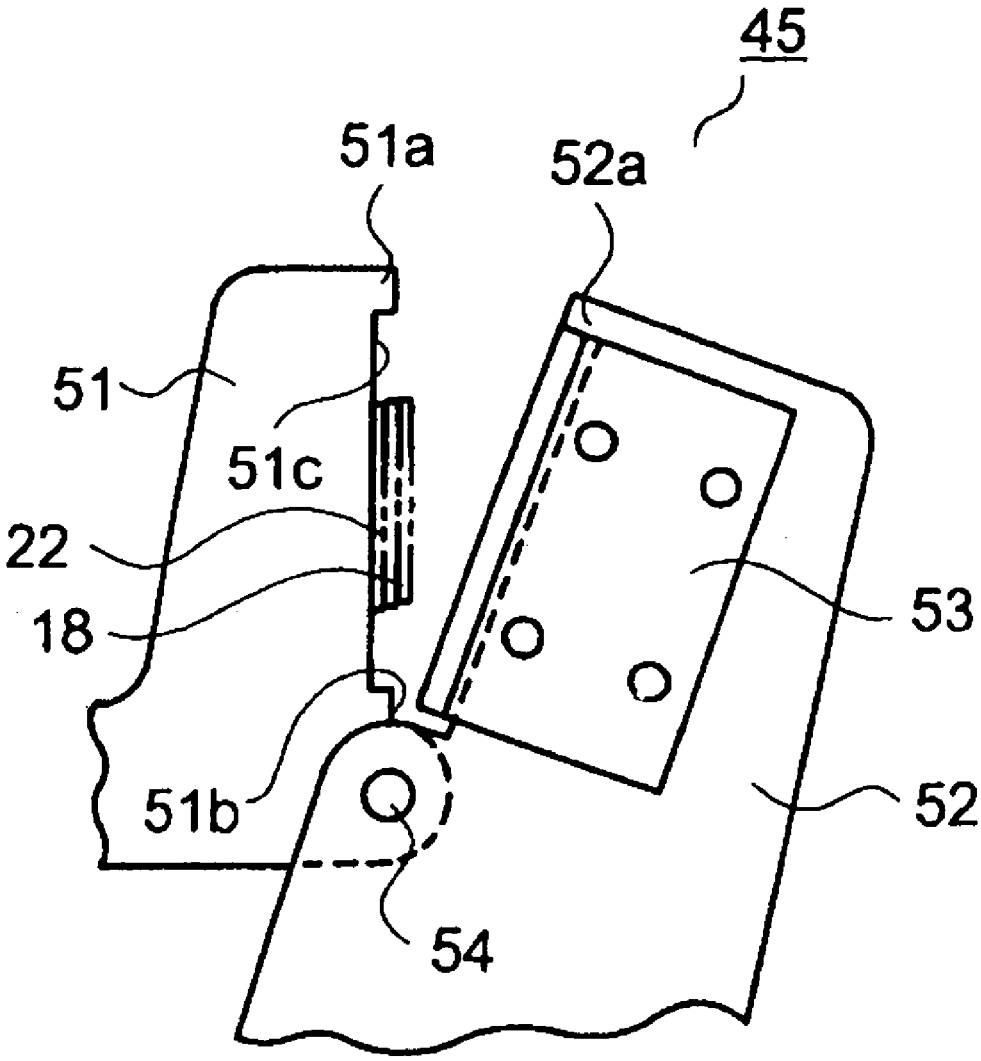
FIG. 15 is a front view illustrating a half cutter of the tape printing apparatus according to an exemplary embodiment of the invention.

As illustrated in FIG. 15, the half cutter 45 is arranged in that a cutter holder 52 is rotatably supported around a shaft portion 54 with respect to an anvil 51. A cutting blade 53 is fixed at the cutter holder 52. Bumps 51*a*, 51*b* are formed at both ends of the anvil 51, and a hollow 51*c* is formed between the bumps 51*a*, 51*b*. The bumps 51*a*, 51*b* are formed to be shallower than the thickness of the separator of the adhesive tape 22.

The cutting blade 53 is positioned to abut the bumps 51*a*, 51*b* such that a tip end portion 52*a* of the cutter holder 52 abuts against the bump 51*a*. The adhesive tape 22 and the transparent tape 18 that are sent from the cassette 8 are disposed at the hollow 51*c*, and by making the cutting blade 53, which is rotated by a DC motor (not shown), abut against the bumps 51*a*, 51*b*, cutting is performed while leaving the separator. A half cut is thus performed.

Figure 3:
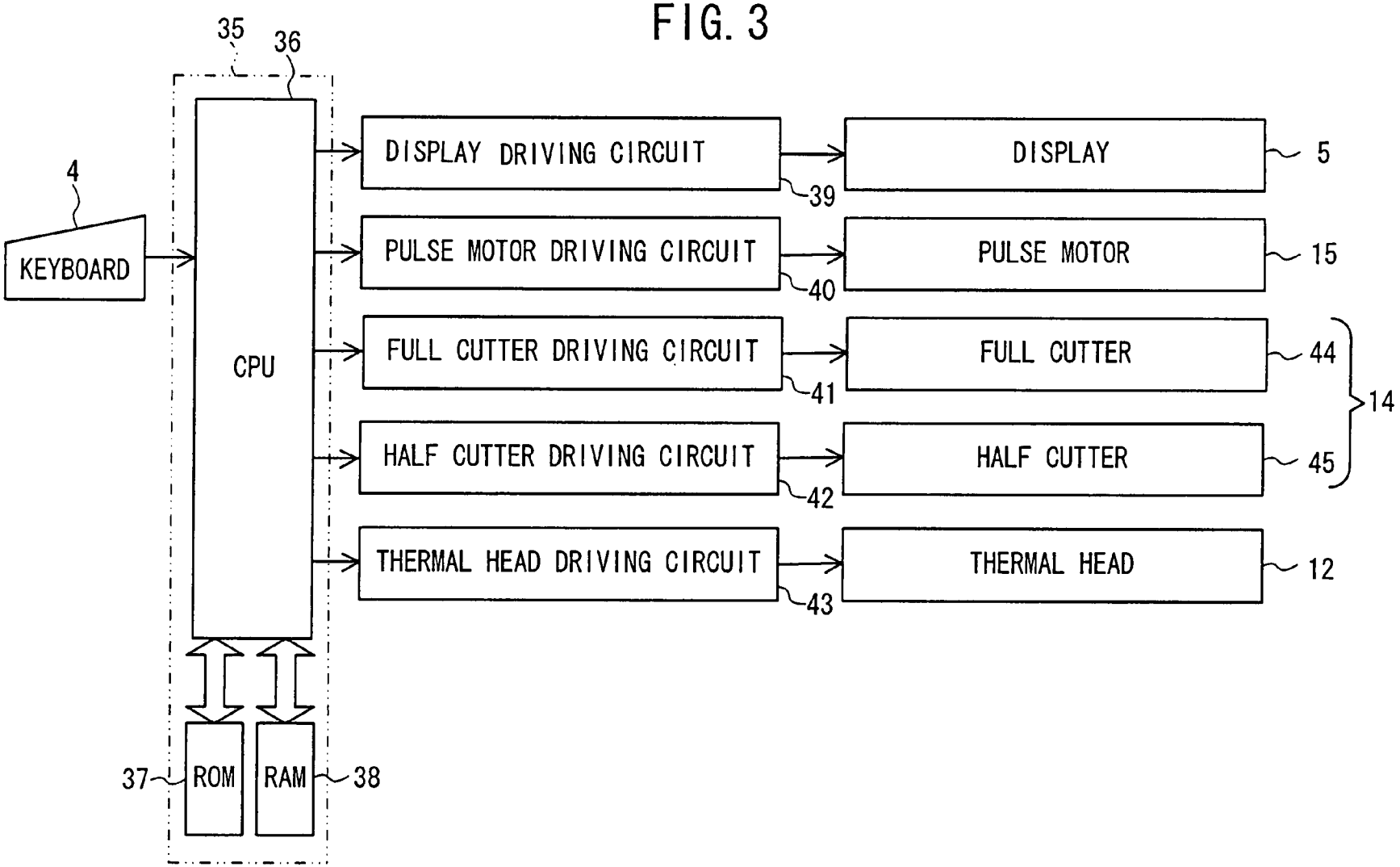
FIG. 3 is a block diagram illustrating a structure of the tape printing apparatus according to an exemplary embodiment of the invention.

FIG. 3 is a block diagram illustrating a structure of the tape printing apparatus 1. The tape printing apparatus 1 comprises a controller 35, including a CPU 36, a ROM 37 and a RAM 38. To the CPU 36, there are connected the keyboard 4, display driving circuit 39, a pulse motor driving circuit 40, a full cutter driving circuit 41, a half cutter driving circuit 42, and a thermal head driving circuit 43.

The display driving circuit 39 drives the display 5 (see FIG. 1). The pulse motor driving circuit 40 drives the pulse motor 15 that rotates the ribbon take-up shaft 10 and the tape feeding shaft 11. The full cuter driving circuit 41 drives the DC motor 33 (FIG. 2) of the full cutter 44 of the cutter mechanism 14. The half cutter driving circuit 42 drives a DC motor (not shown) of the half cutter 45 of the cutter mechanism 14. The thermal head driving circuit 43 drives the thermal head 12.

A character generator for display and printing and various control programs, are stored in the ROM 37. The RAM 38 includes a text data storing area for storing text comprised of input character data and an image buffer for storing images. The stored images may be comprised of print patterns on the basis of texts, or other characters, when performing printing.

Figure 4:
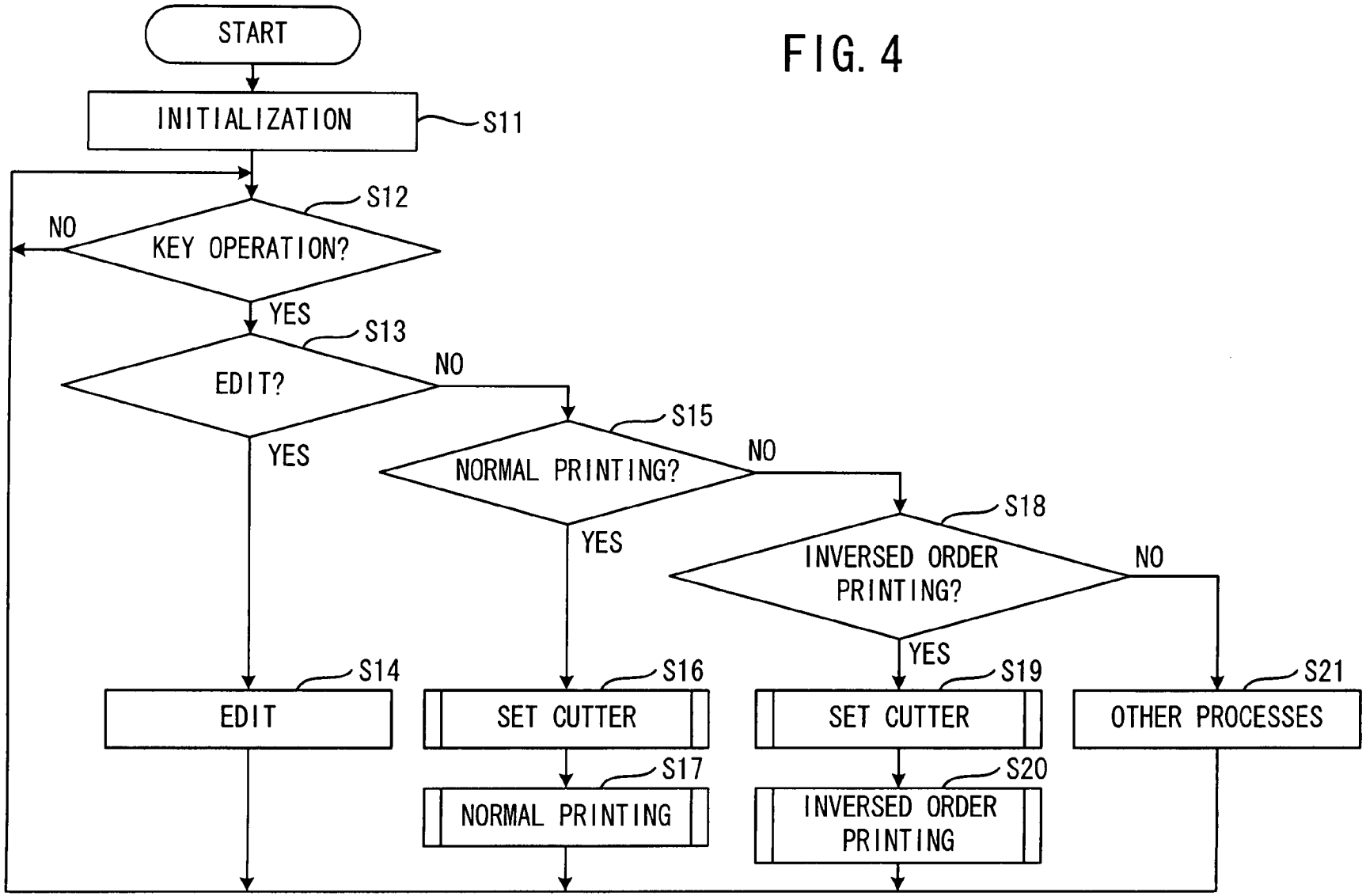
FIG. 4 is a flowchart for illustrating a main program of the tape printing apparatus according to an exemplary embodiment of the invention.

Operation of the tape printing apparatus 1 of the above structure will now be explained with reference to the flowcharts of FIGS. 4 to 7. Upon switching the power of the tape printing apparatus 10N, the main program as illustrated in FIG. 4 is started. In Step S11 of the main program, initialization processes, such as initialization of data, are performed so that a condition is assumed in which key operations can be performed. In Step S12, the apparatus is on stand-by until a key operation is made (NO in Step S12).

If a key operation is made (YES in Step S12), the program proceeds to Step S13, and it is then determined whether editing of the text has been performed upon operation of character keys 6 or other input. If the key operation does not concern editing (NO in Step S13), the program proceeds to Step S15, and it is then determined whether an instruction for normal printing has been made through operation of a function key 7.

If no instruction for normal printing has been made (NO in Step S15), the program proceeds to Step S18, and it is then determined whether an instruction for inversed order printing has been made through operation of a function key 7. If no instruction for inversed order printing has been made (NO in Step S18), the program proceeds to Step S21, and other processes corresponding to key operations are performed whereupon the program returns to Step S12.

If it is determined in Step S13 that the key operation does concern editing (YES in Step S13), the program proceeds to Step S14, and editing of the text is performed through input of desired characters or similar means, and the program then returns to Step S12. By repeating these operations, it is possible to input text comprised of desired character data, linefeed codes, or new block codes by operating the keyboard 4. The new block code forms a block comprised of fixed regions of specified lengths. The linefeed code performs linefeeding of the text within a block. In this respect, the input text is displayed on the display 5, and data of the created text are stored on a text data storing area of the RAM 38.

Figure 7:
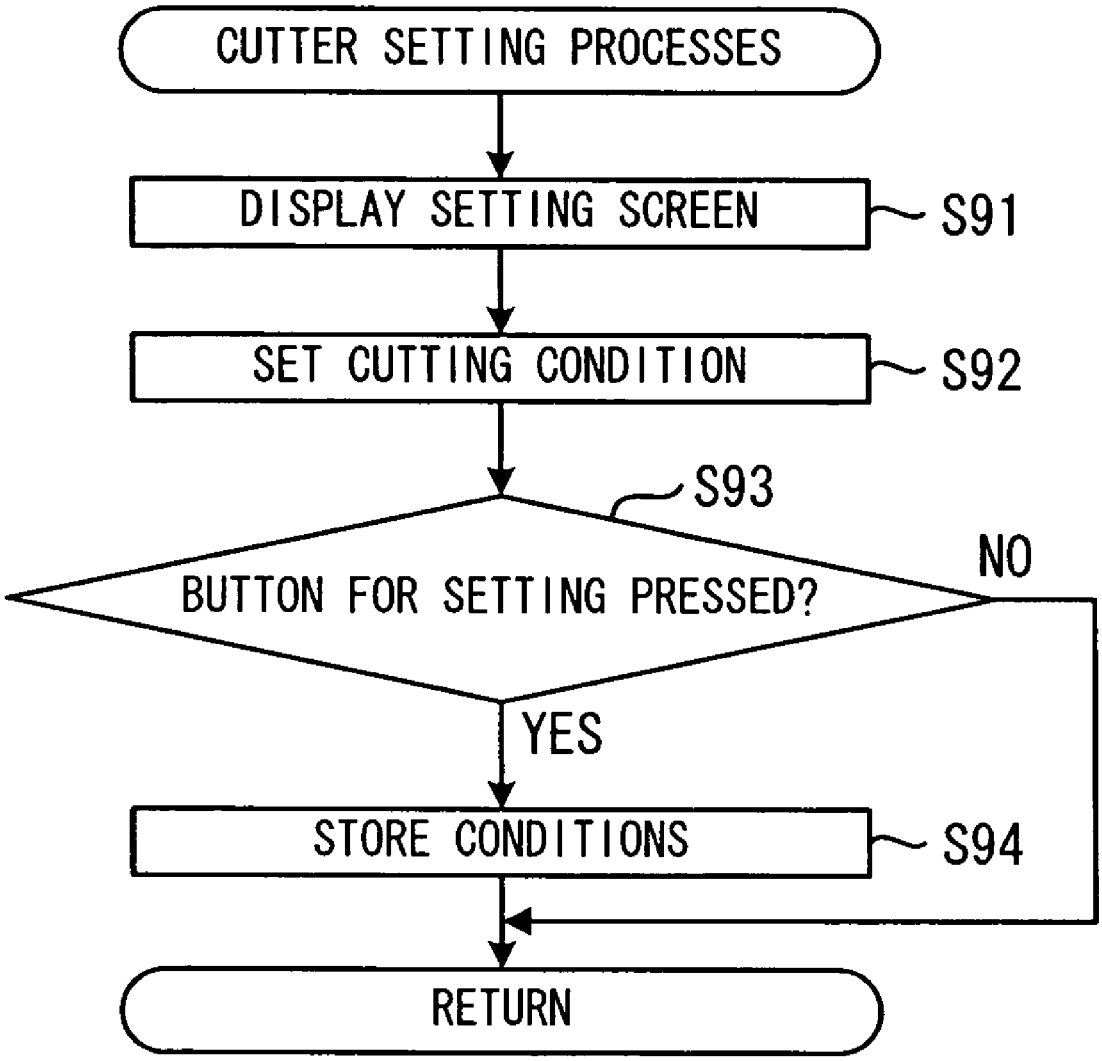
FIG. 7 is a flowchart for illustrating cutter setting processes of the tape printing apparatus according to an exemplary embodiment of the invention.

If it is determined in Step S15 that an instruction for normal printing has been made (YES in Step S15), the program proceeds to Step S16. In Step S16, cutter setting processes as illustrated in FIG. 7 are called up. In the cutter setting processes, a setting screen is displayed on the display 5 in Step S91.

FIGS. 8A to 8D illustrate display screens of the display 5, wherein it is possible to switch the display to any one of FIGS. 8A to 8D through operation of the cursor keys provided at the keyboard 4. In Step S92, cutting conditions for the transparent tape 18 and the adhesive tape 22 are set.

On the display screen 5 of FIG. 8A, by moving the underline in the drawing to any one of "full cut", "half cut" "no cut" through operation of a cursor key, a cutting condition when printing of the tape is completed is selected. For example, "full cut" is selected, the transparent tape 18 and the adhesive tape 22 are cut by the full cutter 44. If "half cut" is selected, the transparent tape 18 and the adhesive tape 22 are cut by the half cutter 45 while leaving the separator of the adhesive tape 22 in tact. If "no cut" is selected, no cutting is performed.

Similarly, it is possible to select cutting conditions at positions of the new block codes on the display screen 5 of FIG. 8B. It is further possible to select cutting conditions at positions of the tab codes on the display screen 5 of FIG. 8C.

It is further possible to select cutting conditions at positions of the space codes on the display screen 5 of FIG. 8D.

In Step S93, it is judged whether a button for setting the condition that has been selected in Step S92 has been pressed. If no setting is to be made, the selected condition is abandoned and the program returns to the main program. If setting is to be made, the program proceeds to Step S94 so that the selected condition is stored in the RAM 38, and the program returns to the main program.

Figure 5:
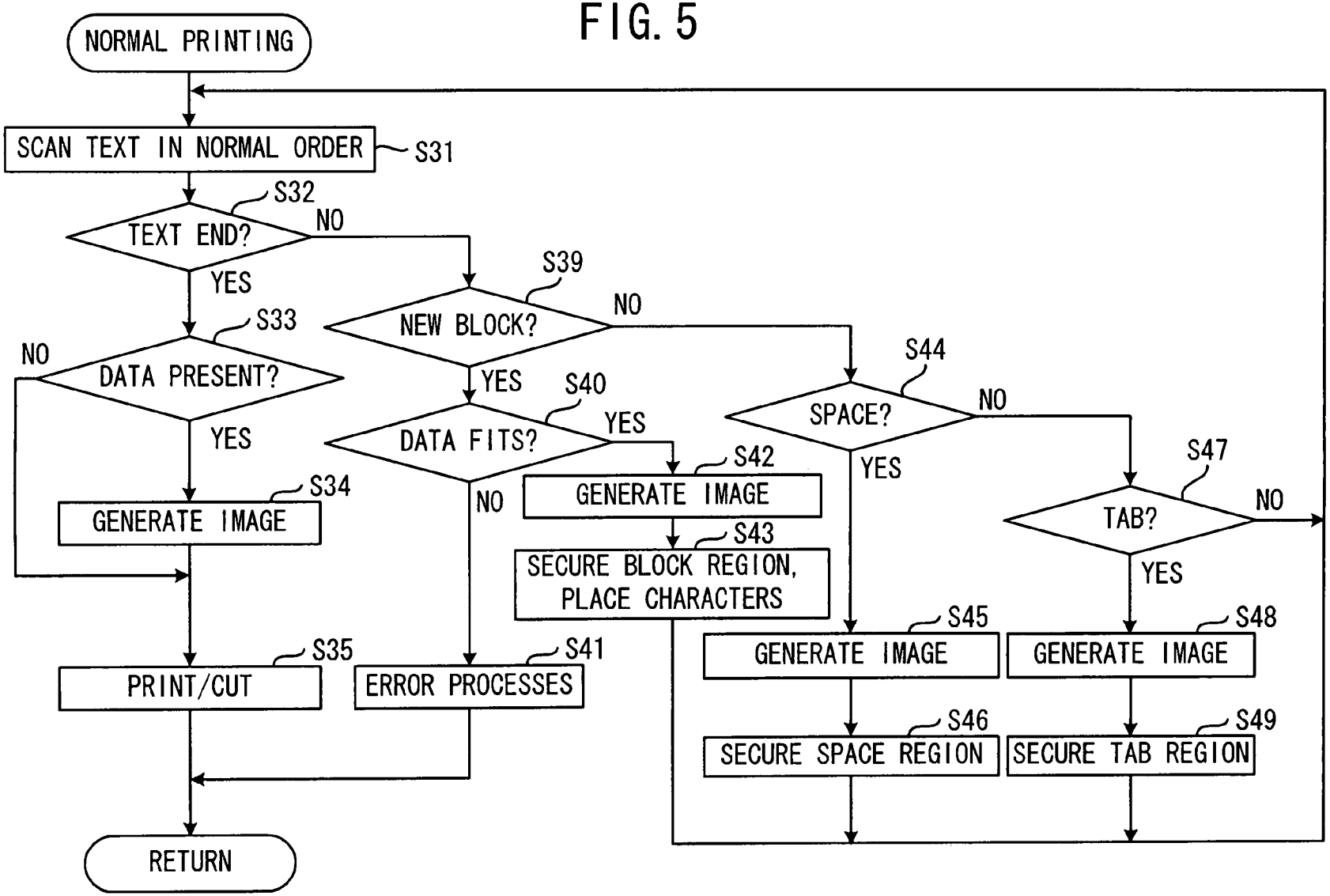
FIG. 5 is a flowchart for illustrating normal printing processes of the tape printing apparatus according to an exemplary embodiment of the invention.

In Step S17 of the main program, normal printing processes, as illustrated in FIG. 5, are called up. In the normal printing processes, an image is printed in the order (normal order) at which the text has been input. In Step S31 of the normal printing processes, the text stored in the text data storing area of the RAM 38 is scanned in normal order data by data for detecting new block codes, space codes and tab codes within the text. In Step S32, it is judged whether the text has been scanned to the end.

If the scanned data is not the end of the text (NO in Step S32), the program proceeds to Step S39, and it is judged whether the scanned data is a new block code. If the scanned data is not a new block code (NO in Step S39), the program proceeds to Step S44 for judging whether the scanned data is a space code. If the scanned data is not a space code (NO in Step S44), the program proceeds to Step S47 for judging whether the scanned data is a tab code. If the scanned data is not a tab code (NO in Step S47), the program returns to Step S31.

When the scanned data is a new block code, it is determined YES in Step S39, and the program proceeds to Step S40. In Step S40, error detection is performed upon determining whether text data (including spaces and tabs) between the detected new block code and the previously detected new block code, or the head of the text, fits into a block comprised of a fixed region of specified length.

This determination is performed by calculating a print length of text data between the detected new block code and the previously detected new block code, or the head of the text, and by comparing this print length with the specified length. If the print length is longer than the specified length and the text data does not fit into the block (NO in Step S40), error processes are performed in Step S41 for indicating this fact, and the program returns to the main program without performing printing.

If the print length is identical to or shorter than the specified length, and the text data fits into the block (YES in Step S40), the program proceeds to Step S42 and an image of text data between the detected new block code and the previously detected new block code, space code, tab code or the head of the text is generated.

In Step S43, an image of a blank region is generated such that the block region of specified length including the image of the text data is secured on the tape, and an image in which characters have been right-aligned, left-aligned or centered, in accordance with the character placement within the block is further generated. If there are space codes or tab codes within the block, character placement is performed by including images of space regions or tab regions that have been generated through Step S45 or Step S48 that will be described later.

The image within the block that is generated while including the space regions or tab regions is stored in the image buffer of the RAM 38. At this time, such an image is stored in addition to image data that are already stored in the image buffer.

If the scanned data is a space code, it is determined YES in Step S44, and the program proceeds to Step S45. In Step S45, an image of text data between the detected space code and the previously detected new block code, space code, tab code or the head of the text is generated. In Step S46, an image of a space region is generated such that the space region (blank region created by the space code) is secured on the tape, and this is additionally stored on the image buffer of the RAM 38. The program then returns to Step S31.

If the scanned data is a tab code, it is determined YES in Step S47, and the program proceeds to Step S48. In Step S48, an image of text data between the detected tab code and the previously detected new block code, space code, tab code or the head of the text is generated.

In Step S49, an image of a tab region is generated such that the tab region (blank region created by the tab code) is secured on the tape, and this data is additionally stored on the image buffer of the RAM 38. The program then returns to Step S31. In this respect, if space codes or tab codes are continuing, only images of respective regions are generated that are stored on the image buffer.

If it is determined in Step S32 that the end of the text has been detected (YES in Step S32), the program proceeds to Step S33. In Step S33, it is determined whether text data are present between the detected text end and the previously detected new block code, space code, tab code or the head of the text.

If no text data are present (NO in Step S33), the program proceeds to Step S35, and printing is performed upon extracting data of the image stored in the image buffer. Cutting of the tape is then performed in accordance with cutting conditions as designated in FIGS. 8A to 8D, and the program returns to the main program.

If it is determined in Step S33 that text data are present (YES in Step S33), the program proceeds to Step S34. In Step S34, an image of text data between the detected text end and the previously detected new block code, space code, tab code or the head of the text is generated. The generated image is additionally stored in the image buffer of the RAM 38. Printing and cutting is then performed in Step S35 to the program returns to the main program.

If it is determined in Step S18 of the main program that inversed order printing has been instructed (YES in Step S18), the program proceeds to Step S19 for performing the above-described cutter setting processes as illustrated in FIG. 7. At this time, the cutting conditions of the previous normal printing or inversed order printing are set as defaults, and when they are to be changed, it is possible to perform setting on the setting screen.

Figure 6:
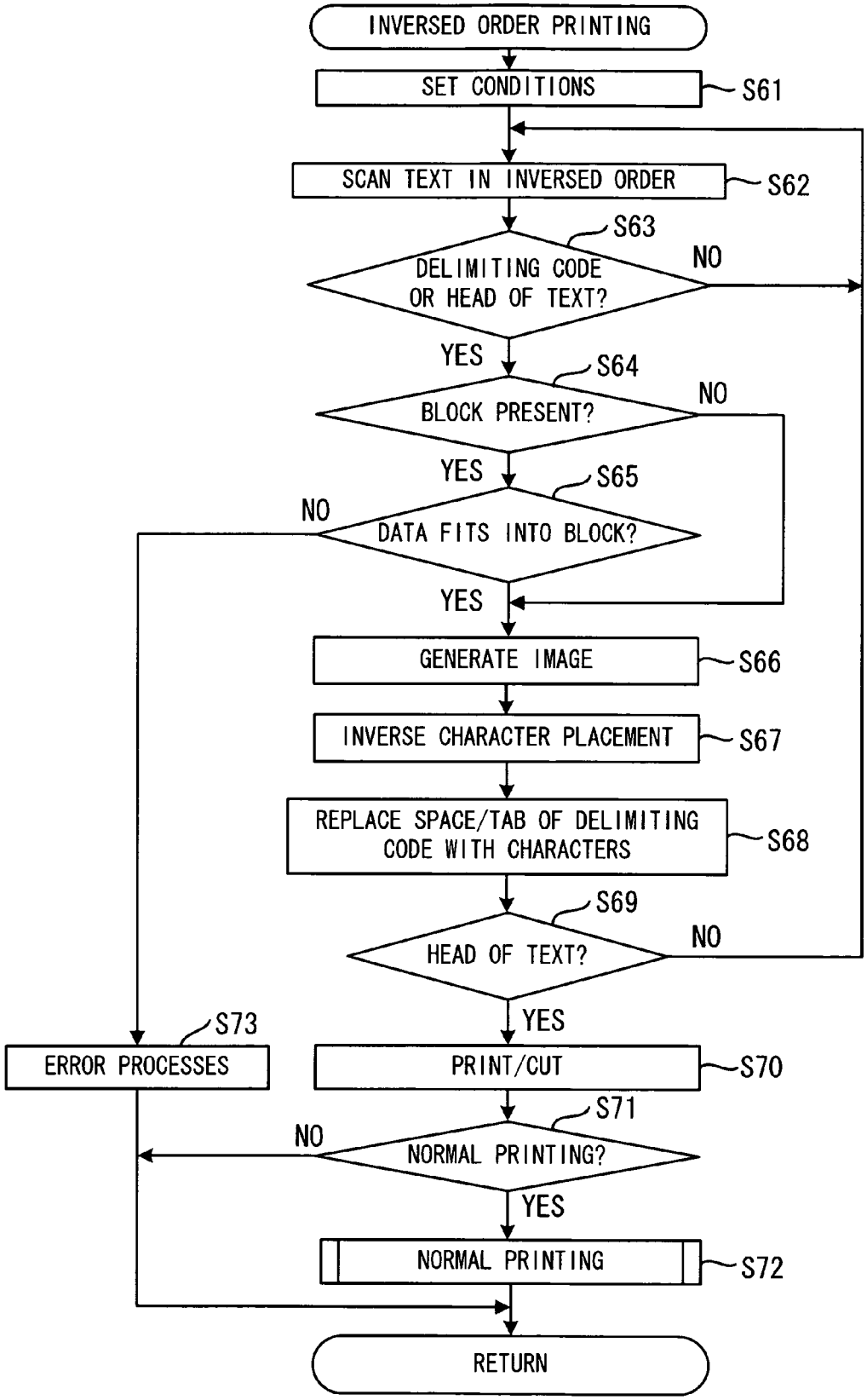
FIG. 6 is a flowchart for illustrating inversed order printing processes of the tape printing apparatus according to an exemplary embodiment of the invention.

In Step S20, the inversed order printing processes as illustrated in FIG. 6 are called up. In the inversed order printing processes, inversed order printing of an image in which character regions that have been delimited by specified delimiting codes are aligned in inversed order and printing is performed. In Step S61 of the inversed order printing processes, conditions for inversed order printing are set.

FIG. 9 illustrates a setting screen for setting delimiting codes. As for the delimiting codes, it is possible to select new block codes, space codes and tab codes. It is also possible to select one or a plurality of codes by operating the select key by moving the cursor to the right or left through movements of the cursor keys in the right and left directions.

In FIG. 9, underlines indicating a selected condition to respective items of the new block code, space code, and the tab code, are marked to indicate that all of these codes have been selected as delimiting codes.

By operating the cursor keys in up and down directions, the program proceeds to the setting screen of FIG. 10. FIG.

10 shows a setting screen for setting whether normal printing is to be simultaneously performed when performing inversed order printing. It is possible to select items "YES" or "NO" when determining whether to perform normal printing by operating a selecting key by moving the cursor to the right and left through cursor keys in right and left directions. By selecting these items, an underline indicative of the selected condition is marked as illustrated in the drawing.

In this manner, it is possible to select between a mode for performing inversed order printing and normal printing in a successive manner (third printing mode) and a mode for performing inversed order printing only (second printing mode). In this respect, by operating a function key 7, a mode for performing normal printing only (first printing mode) is selected upon calling up the normal printing processes while the mode for performing inversed order printing (second and third printing modes) is selected upon calling up the inversed order printing processes.

In Step S62, the text stored in the text data storing area of the RAM 38 is scanned data by data in an opposite order than the order at which the text has been input for detecting delimiting codes that have been set in Step S61. In Step S63, it is judged whether the head of the text or a delimiting code has been detected during scanning. If the scanned data is not the head of the text or a delimiting code (NO in Step S63), the program returns to Step S62. If the head of the text or a delimiting code has been detected (YES in Step S63), the program proceeds to Step S64.

In Step S64, it is determined whether a block is present on the basis of presence or absence of a new block code between the detected head of the text or the delimiting code and the previously detected delimiting code or the end of the text. At this time, it is also determined whether a new block code is set in the delimiting code.

If no block is present (NO in Step S64), the program proceeds to Step S66. If a block is present (YES in Step S64), it is determined in Step S65 whether the text data between new block codes or between a new block code and the head of the text (including spaces and tabs) fits within a block of specified length.

This determination is performed by calculating a print length of text data between the detected new block code and the previously detected new block code, or the head of the text, and by comparing this print length with the specified length. If a plurality of blocks is present, determination is performed for each of the blocks. If the print length is longer than the specified length and the text data does not fit into the block (NO in Step S65), error processes are performed in Step S73 similar to the above described Step S41, and the program returns to the main program without performing printing.

If the print length is identical to or shorter than the specified length and the text data fits into the block (YES in Step S65), the program proceeds to Step S66. In Step S66, an image of text data within a region (character region) between the detected delimiting code or the head of the text and the previously detected delimiting code or the end of the text is generated.

At this time, if the character region includes one or a plurality of new block codes, space codes or tab codes, that are not set as the delimiting code, images of the respective regions are generated similar to when performing normal printing (see FIG. 5). Simultaneously therewith, if the previously detected delimiting code (end side of text) is present, an image of a blank region corresponding to the delimiting code is generated such that a blank region by the delimiting code is secured on the tape. In this respect, no image of the region of the newly detected delimiting code (head side of text) is generated.

In Step S67, the character placement within the block comprised of the entire character region is inversed if one or a plurality of blocks within the character region is a new block code or if the delimiting code is a new block code. More particularly, if the character placement when performing normal printing is right-aligned, a left-aligned image is generated, and if the character placement when performing normal printing is left-aligned, a right-aligned image is generated. In this manner, it is possible to set intervals between characters within the character region or intervals between a character within one character region and a character within an adjoining character region can be made identical to those when performing normal printing in normal order when a right-aligned or left-aligned character place has been made.

In Step S68, a space region or a tab region obtained through a space code or a tab code set as the delimiting code is replaced with a character within a character region. More particularly, a space region or a tab region of which an image has been generated by a delimiting code that has been previously detected is provided at an end of the character region which image has been generated.

An image in which replacement of character positions of the space region or the tab region with those of text data within the character region (including spaces, tabs and new block that are not set as delimiting codes) has been performed is generated. It is thereby possible to dispose adjoining character regions that have been delimited by space codes or tab codes at the same intervals as those when performing normal printing also when disposing them in inversed order.

The images that are generated in Steps S66 to S68 are stored in the image buffer of the RAM 38. At this time, those images are stored in addition to data of images stored in the image buffer.

In Step S69, it is determined whether the character as detected in Step S63 is the head of the text. If a delimiting code is detected (NO in Step S69), the program returns to Step S62, and images of adjoining character regions are sequentially generated. If the head of the text is detected (YES in Step S69), the program proceeds to Step S70.

In Step S70, printing is performed upon extracting data of images stored in the image buffer. Cutting of the tape is then performed in accordance with cutting conditions as described above in reference to FIGS. 8A to 8D.

In Step S71, it is determined whether normal printing is to be successively performed in accordance with set contents on the above-described setting screen of FIG. 10. If normal printing is to be performed (YES in Step S71), the above-described normal printing processes of FIG. 5 are performed in Step S72 whereupon the program returns to the main program. If no normal printing is to be performed (NO in Step S71), the program returns to the main program without performing any processes.

According to an exemplary embodiment, the apparatus comprises a controller 35 with an image buffer (RAM 38) for storing images. It is possible to align and print character regions delimited by delimiting codes in inversed order since the inversed order printing processes that are performed through control of the controller 35. The processes include a step of scanning the text in inversed order (Step S62), a step of detecting a delimiting code or the head of the text (Step S63), a step of generating an image of between delimiting codes, between a delimiting code and the head of the text or between a delimiting code and the end of the text (Step S66), steps of generating images of regions accompanying the delimiting codes for storing the same in the image buffer (Steps S66 to S68), and a step of performing printing upon extracting data of images of the image buffer.

In an exemplary embodiment, is more desirable to provide delimiting code selecting displays for setting one or a plurality of delimiting codes (see FIG. 9), an inversing step of generating an image in which character placement of the block is inversed (Step S67), a replacing step of replacing space regions or tab regions for delimiting character regions with characters within the character region (Step S68), and a successive printing step of successively performing normal printing (Steps S71, 72).

Figure 11A:
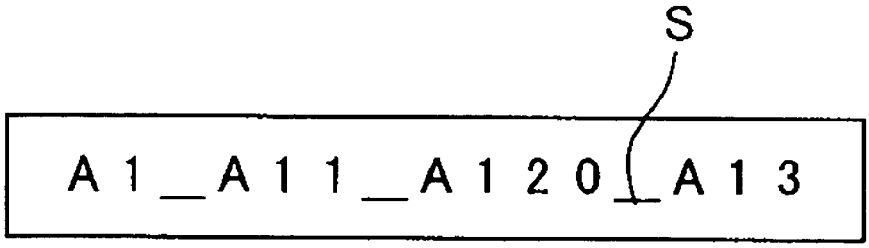
FIG. 11 is a view illustrating results of printing by the tape printing apparatus according to an exemplary embodiment of the invention.
Figure 11B:
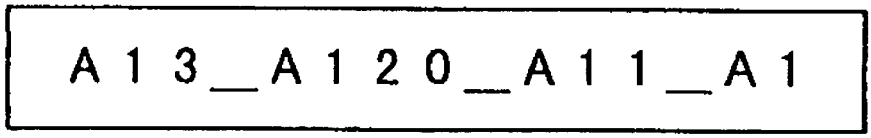

FIGS. 11 to 13 illustrate exemplary results of printing by the tape printing apparatus 1. FIGS. 11A and 11B indicate exemplary printing results of normal printing and inversed printing when space codes are set as the delimiting codes. Steps S12 to S14 of FIG. 4 are repeatedly performed through key operations, and text data comprised of "A1 (space code) A11 (space code) A120 (Space code) A113" are stored in the text data storing area of the RAM 38. If normal printing is designated through key operations, normal printing is performed in Step S17 upon determination of Step S15.

In Step S31 of the normal printing processes of FIG. 5, text data stored in the text data storing area are scanned in normal order, and upon detection of a space code, the program proceeds to Step S45 upon determination of Step S44. In Step S45, an image of "A1" is generated and stored in the image buffer of the RAM 38. In Step S46, an image of the space region is generated and stored in the image buffer.

The program then returns to Step S31 for continued scanning of the text data, and upon detection of the next space code, an image of "A11" is generated in Step S45 to be stored in the image buffer. In Step S46, an image of the space region is generated and stored in the image buffer. Scanning of the text data is similarly continued, and upon detection of the next space code, an image of "A120" is generated in Step S45 to be stored in the image buffer. In Step S46, an image of the space region is generated and stored in the image buffer.

Scanning of the text data is continued upon returning to Step S31, and upon detection of text end, the program proceeds to Step S33 upon determination of Step S32. The program then proceeds to Step S34 for generating an image of "A13" to be stored in the image buffer of the RAM 38. In Step S35, image data stored in the image buffer are called up for performing printing. With this arrangement, the printing results of normal printing, as illustrated in FIG. 11A, are obtained.

If inversed order printing is designated through key operations, inversed order printing is performed in Step S20 upon determination of Step S18 in FIG. 4. In Step S62 of the inversed order printing processes of FIG. 6, the text data stored in the text data storing area are scanned in inverse order from the end of the text. If a space code is detected, the program proceeds to Step S64 upon determination of Step S63. Since it is determined in Step S64 that no block is present, the program proceeds to Step S66. In Step S66, an image of "A13" is generated and stored in the image buffer of the RAM 38.

Upon determination of Step S69, the program returns to Step S62 for continued scanning of text data, and upon detection of a space code, the program proceeds to Step S64 upon determination of Step S63. Because it is determined in Step S64 that no block is present, the program proceeds to Step S66. In Step S66, an image of "A120" and a space region created by the previously detected space code are generated. In Step S68, the space region and the image of "A120" are inversed and stored in the image buffer.

The program similarly returns to Step S62 upon determination of Step S69 for continued scanning of the text data, and upon detection of a space code, the program proceeds to Step S64 upon determination of Step S63. Because it is determined in Step S64 that no block is present, the program proceeds to Step S66. In Step S66, an image of "A11" and a space region created by the previously detected space code are generated. In Step S68, the space region and the image of "A11" are inversed and stored in the image buffer.

The program returns to Step S62 upon determination of Step S69 for continued scanning of the text data, and upon detection of the head of the text, the program proceeds to Step S64 upon determination of Step S63. Because it is determined in Step S64 that no block is present, the program proceeds to Step S66. In Step S66, an image of "A1" and an image of a space region created by the previously detected space code are generated. In Step S68, the space region and the image of "A1" are inversed and stored in the image buffer.

Because scanning has been performed up to the head of the text, the program proceeds to Step S70 upon determination of Step S69, and image data stored in the image buffer are called up for performing printing. In this manner, printing results of inversed order printing, as illustrated in FIG. 11B are obtained.

According to FIGS. 11A and 11B, the printing results of normal printing are comprised of a character string in which character regions delimited by space regions S are aligned. These character regions are aligned in an order inverse of their order of input and are delimited by the space regions S when performing inversed order printing.

Figure 12A:
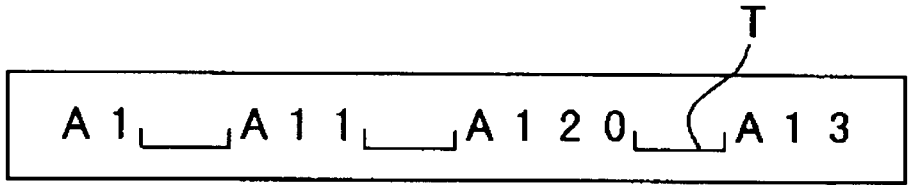
FIG. 12 is a view illustrating results of printing by the tape printing apparatus according to an exemplary embodiment of the present invention.
Figure 12B:
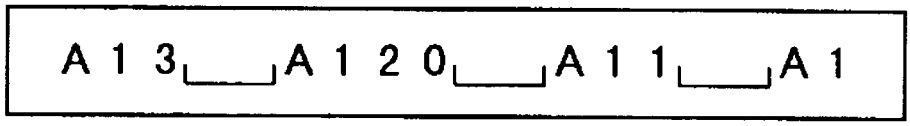

FIGS. 12A and 12B illustrate exemplary printing results of normal printing and inversed order printing in which tab codes are set as delimiting codes. Through key operations, Steps S12 to S14 are repeatedly performed, and text data comprised of "A1 (tab code) A11 (tab code) A120 (tab code) A13 are stored in the text data storing area of the RAM 38. If normal printing is instructed through key operations, normal printing is performed in Step S17 upon determination of Step S15.

In Step S31 of the normal printing process of FIG. 5, the text data stored in the text data storing area are scanned in normal order, and upon detection of a tab code, the program proceeds to Step S45 upon determination of Step S47. In Step S48, an image of "A1" is generated and stored in the image buffer of the RAM 38. In Step S49, an image of the tab region is generated and stored in the image buffer.

The program returns to Step S31 for continued scanning of the text data, and upon detection of the next tab code, an image of "A11" is generated in Step S48 and stored in the image buffer. In Step S49, an image of the tab region is generated and stored in the image buffer. Scanning of the text data is similarly continued and upon detection of the next tab code, an image of "A120" is generated in Step S48 and stored in the image buffer. In Step S49, an image of the tab region is generated and stored in the image buffer.

The program returns to Step S31 for continued scanning of the text data, and upon detection of the text end, the program proceeds to Step S33 upon determination of Step S32. The program then proceeds to Step S34 for generating an image of "A13" and storing the same in the image buffer. In Step S35, the image data stored in the image buffer are called up for performing printing. In this manner, printing results of normal printing, as illustrated in FIG. 12A, are obtained.

If inversed order printing is instructed through key operations, inversed order printing is performed in Step S20 upon determination of Step S18 in FIG. 4. In Step S62 of the inversed order printing processes of FIG. 6, text data, stored in the text data storing area, are scanned in inverse order starting from the end of the text. Upon detection of a tab code, the program proceeds to Step S64 upon determination of Step S63. Because it is determined in Step S64 that no block is present, the program proceeds to Step S66. In Step S66, an image of "A13" is generated and stored in the image buffer of the RAM 38.

The program returns to Step S62 upon determination of Step S69 for continued scanning of the text data, and upon detection of the next tab code, the program proceeds to Step S64 upon determination of Step S63. Because it is determined in Step S64 that no block is present, the program proceeds to Step S66. In Step S66, an image of "A120" and a tab region through a previously detected tab code are generated. In Step S68, the tab region and the image of "A120" are inversed and stored in the image buffer.

The program similarly returns to Step S62 upon determination of Step S69 for continued scanning of the text data, and upon detection of the tab code, the program proceeds to Step S64 upon determination of Step S63. Because it is determined in Step S64 that no block is present, the program proceeds to Step S66. In Step S66, an image of "A11" and a tab region through a previously detected tab code are generated. In Step S68, the tab region and the image of "A11" are inversed and stored in the image buffer.

The program returns to Step S62 upon determination of Step S69 for continued scanning of the text data, and upon detection of the head of the text, the program proceeds to Step S64 upon determination of Step S63. Because it is determined in Step S64 that no block is present, the program proceeds to Step S66. In Step S66, an image of "A1" and a tab region through a previously detected tab code are generated. In Step S68, the tab region and the image of "A1" are inversed and stored in the image buffer.

Because scanning has been performed up to the head of the text, the program proceeds to Step S70 upon determination of Step S69, and image data stored in the image buffer are called up for performing printing. In this manner, printing results of inversed order printing as illustrated in FIG. 12B.

According to FIGS. 12A and 12B, the exemplary printing results of normal printing are comprised of a character string in which character regions delimited by tab regions T are aligned. These character regions are aligned in an order inverse of their order of input and are delimited by the tab regions T when performing inversed order printing.

Figure 13A:
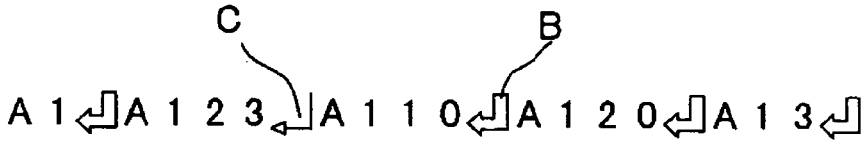
FIG. 13 is a view illustrating results of printing by the tape printing apparatus according to an exemplary embodiment of the invention.
Figure 13B:
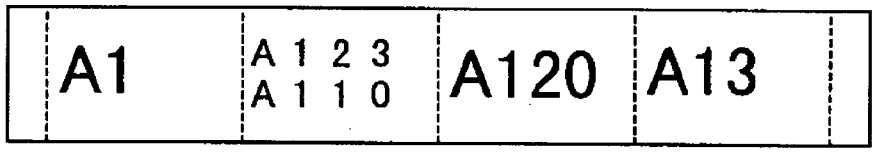
Figure 13C:
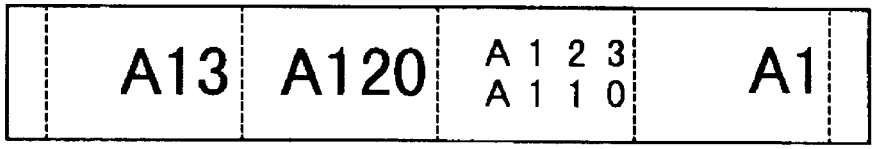

FIGS. 13A, 13B and 13C illustrate exemplary input data, printing results of normal printing and printing results of inversed order printing in which new block codes are set as delimiting codes. The input data are comprised of a text including return codes C and new block codes B. Steps S12 to S14 of FIG. 4 are repeatedly performed through key operations, and text data comprised of "A1 (new block code) A123 (linefeed code) A110 (new block code) A120 (new block code) A13" are stored in the text data storing area of the RAM 38. If normal printing is designated through key operations, normal printing is performed in Step S17 upon determination of Step S15.

In Step S31 of the normal printing processes of FIG. 5, text data stored in the text data storing area are scanned in normal order, and upon detection of a new block code, the program proceeds to Step S40 for error detection upon determination of Step S39 and then proceeds to Step S42. In Step S42, an image of "A1" is generated and stored in the image buffer of the RAM 38. In Step S43, an image of a blank region is generated for forming a block region of a specified length, and an image in which the character placement is left-aligned is generated. The generated image is stored in the image buffer of the RAM 38.

The program returns to Step S31 for continued scanning of the text data, and upon detection of a next new block code, an image of "A123 (linefeed code) A110" is generated in Step S42 and stored in the image buffer. In Step S43, an image of a blank region is generated for forming a block region, and an image in which the character placement is left-aligned is generated and stored in the image buffer. In this respect, line-feeding of character strings within the block is performed by the linefeed codes C.

Scanning of the text data is similarly continued, and upon detection of the next linefeed code, an image of "A120" is generated in Step S42 and stored in the image buffer. In Step S43, an image of a blank region is generated for forming a block region, and an image in which the character placement is left-aligned is generated and stored in the image buffer.

Scanning of the text data is further continued, and upon detection of the next linefeed code, an image of "A13" is generated in Step S42 and stored in the image buffer. In Step S43, an image of a blank region is generated for forming a block region, and an image in which the character placement is left-aligned is generated and stored in the image buffer.

The program returns to Step S31 for continued scanning of the text data, and upon detection of the text end, the program proceeds to Step S33 upon determination of Step S32. In Step S33, it is determined whether data are present between the previously detected new block code and the text end. If no data are present, the program proceeds to Step S35. In Step S35, image data stored in the image buffer are called up for performing printing. In this manner, printing results of normal printing in which blocks of a specified length are aligned are obtained as illustrated in FIG. 13B.

If inversed order printing is instructed through key operations, inversed order printing is performed in Step S20 upon determination of Step S18 in FIG. 4. In Step S62 of the inverse order printing processes of FIG. 6, text data stored in the text data storing area are scanned in inversed order starting from the end of the text. Upon detection of a new block code, the program proceeds to Step S64 upon determination of Step S63. Because it is determined in Step S64 that no block for detecting the first new block code is present starting from the end of the text, the program proceeds to Step S66. Nothing is performed in Steps S66, S67 and S68 because no data are present, and the program returns to Step S62 upon determination of Step S69.

In Steps S62 and S63 scanning of the text data is continued, and upon detection of the next new block code, the program proceeds to Step S64 upon determination of Step S63. Because it is determined in Step S64 that a block is present between delimiting codes, the program proceeds to Step S66 after error detection in Step S65.

In Step S66, an image of "A13" and an image of a blank region for forming a block region of a specified length are generated. In Step S67, an image in which the character placement within the block is inversed to be right-aligned is generated and stored in the image buffer. Nothing is then performed in Step S68, and the program returns to Step S62 upon determination of Step S69.

In Step S66, an image of "A120" and an image of a blank region for forming a block region of a specified length are generated. In Step S67, an image in which the character placement within the block is inversed to be right-aligned in generated and stored in the image buffer. Nothing is then performed in Step S68, and the program returns to Step S62 upon determination of Step S69.

In Steps S62 and S63, scanning of the text data is continued, and upon detection of the next new block code, the program proceeds to Step S64 upon determination of Step S63. Because it is determined in Step S64 that a block is present between delimiting codes, the program proceeds to Step S66 after performing error detection in Step S65.

In Step S66, an image of "A123 (linefeed code) A110" and an image of a blank region for forming a block region of a specified length are generated. In Step S67, an image in which the character placement within the block is inversed to be right-aligned is generated and stored in the image buffer. Nothing is then performed in Step S68, and the program returns to Step S62 upon determination of Step S69.

In Steps S62 and S63, scanning of the text data is continued, and upon detection of the head of the text, the program proceeds to Step S64 upon determination of Step S63. Because it is determined in Step S64 that a block is present between the previously detected delimiting code and the head of the text, the program proceeds to Step S66 after performing error detection in Step S65. In Step S66, an image of "A1" and an image of a blank region for forming a block region of a specified length are generated. In Step S67, an image in which the character placement within the block is inversed to be right-aligned is generated and stored in the image buffer.

Because scanning has been performed up to the head of the text, the program proceeds to Step S70 upon determination of Step S69, and the image data stored in the image buffer are called up for performing printing. In this manner, the printing results of inversed order printing, as illustrated in FIG. 13C are obtained.

According to FIGS. 13B and 13C, the exemplary printing results of normal printing are comprised of a character string in which character regions formed by blocks of left-aligned character placement are aligned. These character regions are aligned in an order inverse of their order of input and in which the character placement within the blocks is inversed to be right-aligned when performing inversed order printing.

Figure 14:
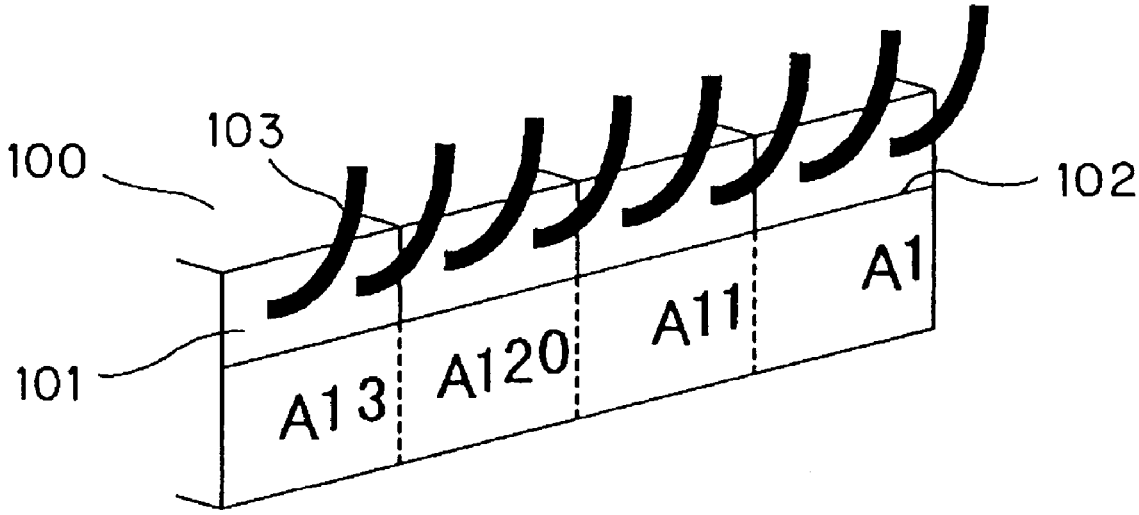
FIG. 14 is a perspective view illustrating an example of use of a tape that has been printed by the tape printing apparatus according to an exemplary embodiment of the invention.
Figure 16:
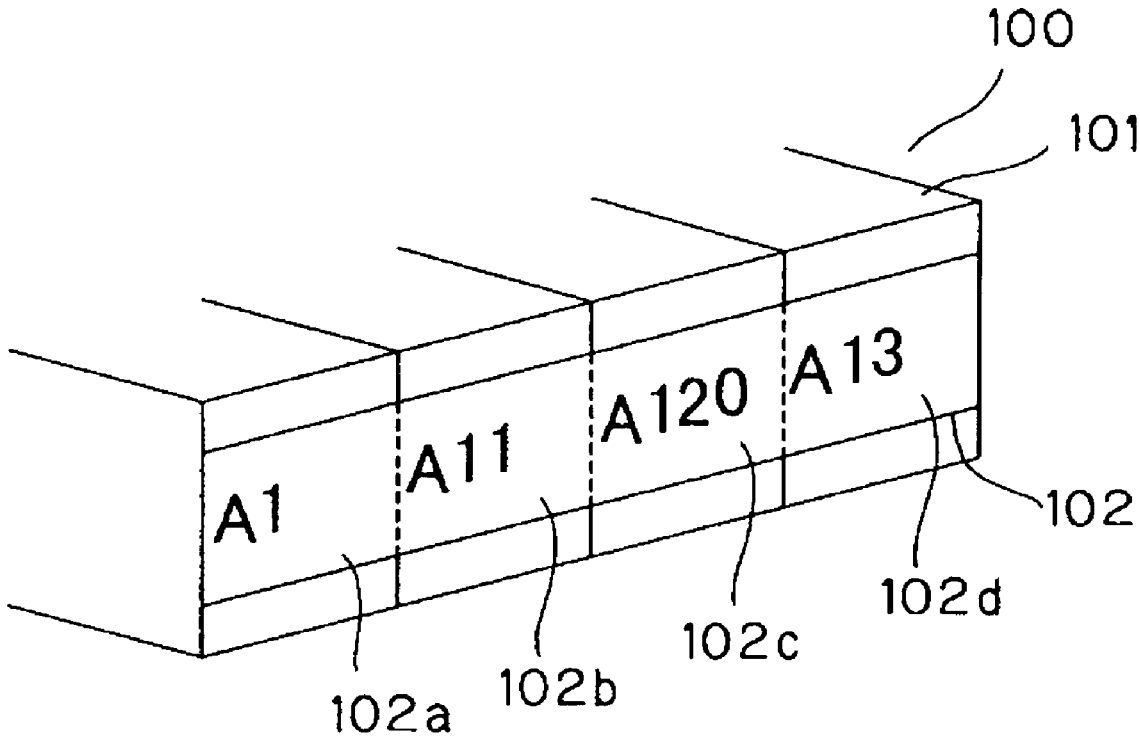
FIG. 16 Related Art
FIG. 16 is a perspective view illustrating an example of use of the tape that has been printed by a conventional tape printing apparatus.

As illustrated in the above-described FIG. 16, the normally printed tapes can be adhered to the distribution board 100 in the same manner as in the prior art for easily specifying connectors to be connected to the respective breakers 101. Further, by adhering the inversely printed tapes onto the rear surface side of the respective breakers 101 of the distribution board 100 as illustrated in FIG. 14, cables 103 can be easily connected when performing connecting operations. Accordingly it will not be necessary to input the same data twice in normal order and in inversed order to thus improve the convenience of users.

According to the present invention, it is possible to perform inversed order printing for printing character strings in which the order of character regions is inversed so that tapes indicating connectors to be connected, when seen from a rear surface side of a distribution board, can be easily created. Thus, it is possible to obtain a tape printing apparatus of improved convenience.

In the illustrated embodiments, a controller (CPU 36) preferably is implemented using a suitably programmed general purpose computer, e.g., a microprocessor, microcontroller or other processor device (CPU or MPU). It will be appreciated by those skilled in the art, that the controller also can be implemented as a single special purpose integrated circuit (e.g., ASIC) having a main or central processor section for overall, system-level control, and separate sections dedicated to performing various different specific computations, functions and other processes under control of the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the invention.

While the invention has been described with reference to exemplary embodiments, it is to be understood that the invention is not limited to the exemplary embodiments or constructions. Although the various elements of the exemplary embodiments are shown in various combinations and configurations, which are exemplary, other combinations and configurations, including more, less or only a single element, are also within the spirit and scope of the invention.

What is claimed is:

1. A tape printing apparatus that prints a character string including a plurality of character regions divided by specified delimiting codes onto a tape, the apparatus comprising a controller that:

controls normal printing with the character regions being printed in an order in which the characters were input; and controls inversed order printing of a character string with the character regions being printed in an order inverse to which the characters were input.

2. The tape printing apparatus according to claim 1, further comprising a controller that controls selecting between the normal printing and the inversed order printing.

3. The tape printing apparatus according to claim 1, further comprising a controller that controls successively performing the normal printing and the inversed order printing.

4. The tape printing apparatus according to claim 3, including a first printing mode in which the normal printing is performed, a second printing mode in which the inversed order printing is performed, and a third printing mode in which the normal printing and the inversed order printing are successively performed.

5. The tape printing apparatus according to claim 1, wherein the delimiting codes are comprised of at least one of a plurality of space codes, tab codes and new block codes.

6. The tape printing apparatus according to claim 5, further comprising a controller that controls selecting at least one of a plurality of space codes, tab codes and new block codes.

7. The tape printing apparatus according to claim 1, further comprising a controller that controls inversing placement of characters within each of the character regions when performing the inversed order printing.

8. The tape printing apparatus according to claim 1, further comprising a controller that controls replacing at least one of space regions and tab regions that delimit the character regions with characters within the character regions when performing said inversed order printing.

9. The tape printing apparatus according to claim 1, further comprising a controller that:

controls a cutter mechanism that cuts the tape; and controls setting the same cutting conditions of the cutter when performing the normal printing and the inversed order printing.

10. A tape printing apparatus that prints a character string including a plurality of character regions divided by specified delimiting codes onto a tape, the apparatus comprising a controller that:

controls normal printing with the character regions being printed in an order in which the characters were input; and controls inversed order printing for printing a character string with the character regions being printed in an order inverse to which the characters were input; and controls selecting between the normal printing and the inversed order printing.

11. The tape printing apparatus according to claim 10, further comprising a controller that controls successively performing the normal printing and the inversed order printing.

12. The tape printing apparatus according to claim 11, including a first printing mode in which the normal printing is performed, a second printing mode in which the inversed order printing is performed, and a third printing mode in which the normal printing and the inversed order printing are successively performed.

13. The tape printing apparatus according to claim 10, wherein the delimiting codes are comprised of at least one of a plurality of space codes, tab codes and new block codes.

14. The tape printing apparatus according to claim 13, further comprising a controller that controls selecting at least one of a plurality of space codes, tab codes and new block codes.

15. The tape printing apparatus according to claim 10, further comprising a controller that controls inversing placement of characters within each of the character regions when performing the inversed order printing.

16. The tape printing apparatus according to claim 10, further comprising a controller that controls replacing at least one of space regions and tab regions that delimit the character regions with characters within the character regions when performing the inversed order printing.

17. The tape printing apparatus according to claim 10, further comprising a controller that:

controls a cutter mechanism that cuts the tape; and controls setting the same cutting conditions of the cutter when performing the normal printing and the inversed order printing.

18. A tape printing apparatus that prints a character string including a plurality of character regions divided by specified delimiting codes onto a tape, the apparatus comprising:

a normal printing mechanism that performs normal printing with the character regions being in a normal order; and an inversed printing mechanism that performs inversed order printing for printing a character string with the character regions being in inversed order.

19. The tape printing apparatus according to claim 18, further comprising a controller that selects the normal order and the inversed order.

20. The tape printing apparatus according to claim 18, further comprising a successive printing mechanism that successively performs the normal printing and the inversed order printing.

21. The tape printing apparatus according to claim 20, including a first printing mode in which the normal printing is performed, a second printing mode in which the inversed order printing is performed, and a third printing mode in which the normal printing and the inversed order printing are successively performed.

22. The tape printing apparatus according to claim 18, wherein the delimiting codes are comprised of at least one of a plurality of space codes, tab codes and new block codes.

23. The tape printing apparatus according to claim 22, further comprising a controller that selects at least one of a plurality of space codes, tab codes and new block codes.

24. The tape printing apparatus according to claim 18, further comprising a controller that inverses placement of characters within each of the character regions when performing the inversed order printing.

25. The tape printing apparatus according to claim 18, further comprising a controller that replaces at least one of space regions and tab regions that delimit the character regions with characters within the character regions when performing the inversed order printing.

26. The tape printing apparatus according to claim 18, further comprising:

a cutter mechanism that cuts the tape; and a controller that sets the same cutting conditions of the cutter when performing the normal printing and the inversed order printing.

27. A tape printing apparatus that prints a character string including a plurality of character regions divided by specified delimiting codes onto a tape, the apparatus comprising:

a normal printing mechanism that performs normal printing with the character regions being in a normal order; and an inversed printing mechanism that performs inversed order printing for printing a character string with the character regions being in inversed order, wherein the apparatus further includes a controller that selects between the normal printing and the inversed order printing.

28. The tape printing apparatus according to claim 27, further comprising a successive printing mechanism that successively performs the normal printing and the inversed order printing.

29. The tape printing apparatus according to claim 28, including a first printing mode in which the normal printing is performed, a second printing mode in which the inversed order printing is performed, and a third printing mode in which the normal printing and the inversed order printing are successively performed.

30. The tape printing apparatus according to claim 27, wherein the delimiting codes are comprised of at least one of a plurality of space codes, tab codes and new block codes.

31. The tape printing apparatus according to claim 30, wherein the controller selects at least one of a plurality of space codes, tab codes and new block codes.

32. The tape printing apparatus according to claim 27, wherein the controller inverses placement of characters within each of the character regions when performing the inversed order printing.

33. The tape printing apparatus according to claim 27, wherein the controller replaces at least one of space regions and tab regions that delimit the character regions with character within the character regions when performing the inversed order printing.

34. The tape printing apparatus according to claim 27, further comprising a cutter mechanism that cuts the tape, wherein the controller sets the same cutting conditions of the cutter when performing the normal printing and the inversed order printing.

35. A method of controlling a tape printing apparatus that prints a character string including a plurality of character regions divided by specified delimiting codes onto a tape, the method comprising:

performing normal printing with the character regions being in a normal order; and performing inversed order printing for printing a character string with the character regions being in inversed order.

36. The method according to claim 35, further comprising selecting the normal order and the inversed order.

37. The method according to claim 35, further comprising performing successive printing in which the normal printing and the inversed order printing are successively performed.

38. The method according to claim 37, including a first printing mode in which the normal printing is performed, a second printing mode in which the inversed order printing is performed, and a third printing mode in which the normal printing and the inversed order printing are successively performed.

39. The method according to claim 35, wherein the delimiting codes are comprised of at least one of a plurality of space codes, tab codes and new block codes.

40. The method according to claim 39, further comprising selecting at least one of a plurality of space codes, tab codes and new block codes.

41. The method according to claim 35, further comprising inversing placement of characters within each of the character regions when performing the inversed order printing.

42. The method according to claim 35, further comprising replacing space regions or tab regions that delimit the character regions with characters within the character regions when performing the inversed order printing.

43. The method according to claim 35, further comprising:

setting the same cutting conditions of a cutter mechanism that cuts the tape when performing the normal printing and the inversed order printing.

* * * * *